US005993357A

United States Patent [19]

Tom et al.

[11] Patent Number: 5,993,357

[45] Date of Patent: Nov. 30, 1999

[54] NECK EXERCISE APPARATUS

[76] Inventors: James L. Tom, 6651 Colton Blvd., Oakland, Calif. 94611; David J. Gilman, 312 Todd Way, Mill Valley, Calif. 94941; Jerome A. Schofferman, 90 Glen Ave., Sausalito, Calif. 94965

[21] Appl. No.: 08/914,251

[22] Filed: Aug. 19, 1997

[51] Int. Cl.[6] ..... A63B 23/025; A63B 21/04

[52] U.S. Cl. ..... 482/10; 482/121; 482/129

[58] Field of Search ..... 482/10, 11, 30–32, 482/77, 121, 128–130, 26; 5/642; 73/379.01

[56] References Cited

U.S. PATENT DOCUMENTS

| | | | |
|---|---|---|---|
| 436,462 | 9/1890 | Reach | 482/30 |
| 3,058,743 | 10/1962 | Gabrielson et al. | 482/30 |
| 3,219,358 | 11/1965 | Hagner | 482/77 |
| 3,765,693 | 10/1973 | Morrison et al. | 482/77 |
| 4,018,438 | 4/1977 | Shoger | 482/26 |
| 4,199,136 | 4/1980 | Mansfield | 482/26 |
| 4,428,577 | 1/1984 | Weingardt . | |
| 4,789,154 | 12/1988 | Mattox . | |
| 4,893,808 | 1/1990 | McIntyre . | |
| 5,005,832 | 4/1991 | Van Der Hoeven . | |
| 5,116,359 | 5/1992 | Moore . | |
| 5,135,445 | 8/1992 | Christensen et al. | 482/10 |
| 5,273,504 | 12/1993 | Jones . | |
| 5,336,138 | 8/1994 | Arjawat . | |
| 5,336,141 | 8/1994 | Vittone | 482/130 |
| 5,501,646 | 3/1996 | Miller . | |
| 5,562,575 | 10/1996 | Gvoich | 482/52 |
| 5,669,862 | 9/1997 | Sayman . | |

FOREIGN PATENT DOCUMENTS

| | | |
|---|---|---|
| 2631067 | 1/1977 | German Dem. Rep. . |

OTHER PUBLICATIONS

Advertisement, "Introduces the Neck Trainer" by Rockett Exercise Concepts, Inc., Clearwater, FL (3pp) Feb. 13, 1998.

"Operator's Guide to the Nexeciser" Operating Manual, Nexerciser, Inc., Bedford, NH, Jun, 1993 (3pp).

*Primary Examiner*—Richard J. Apley
*Assistant Examiner*—Victor K. Hwang
*Attorney, Agent, or Firm*—Jonathan Jaech

[57] ABSTRACT

A neck exercise apparatus for developing strength, endurance, and flexibility in the neck. The apparatus comprises a leaf spring that is held by a support at each end. The leaf spring and its supports are mounted on a base. The distance between the supports can be adjusted to vary the force necessary to deflect the leaf spring. A gauge block may be placed beneath the center of the spring to measure and to limit the range of motion of the exercise. In an alternative embodiment of the invention, a single semielliptical leaf spring replaces the leaf spring and two supports of the preferred embodiment.

3 Claims, 8 Drawing Sheets

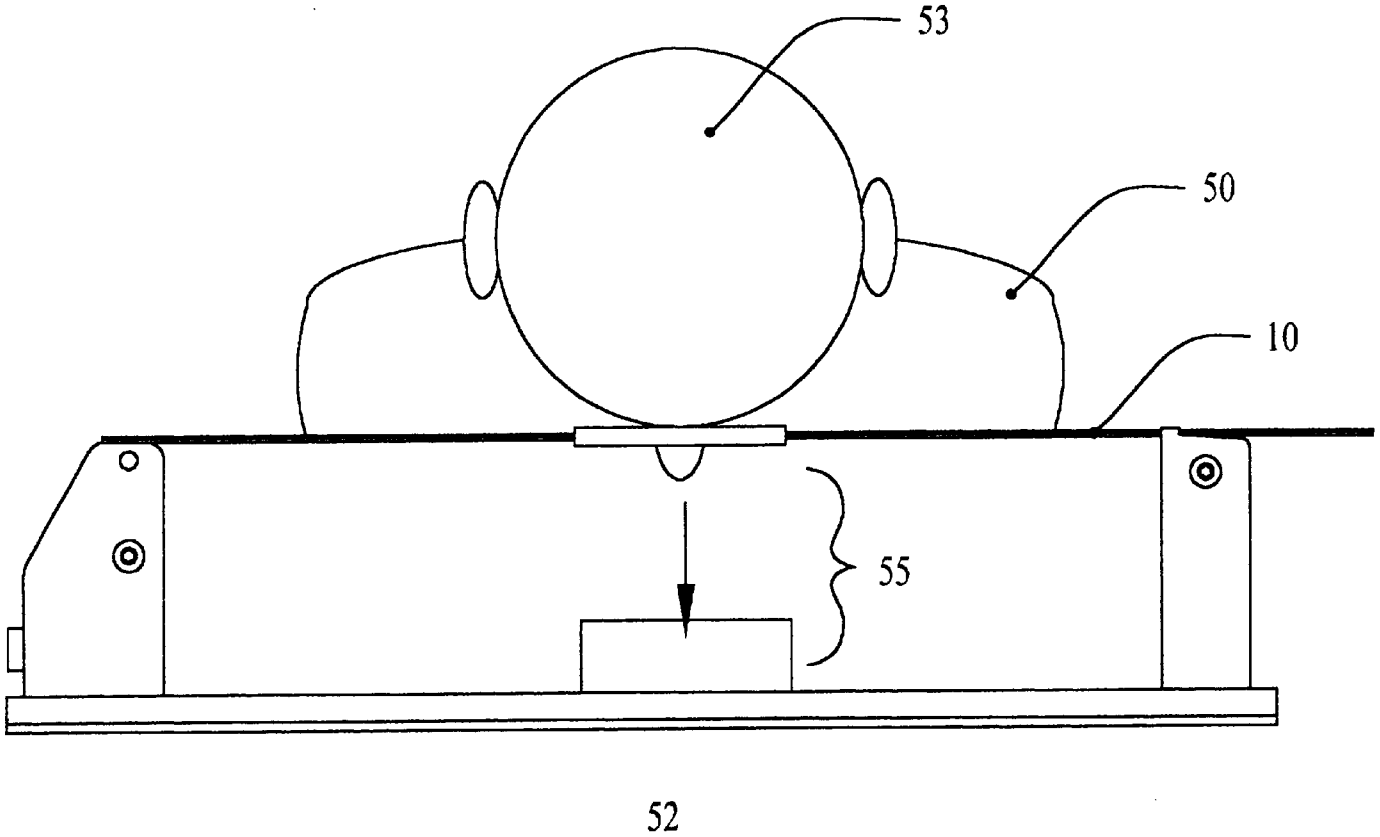
FIG 5-A

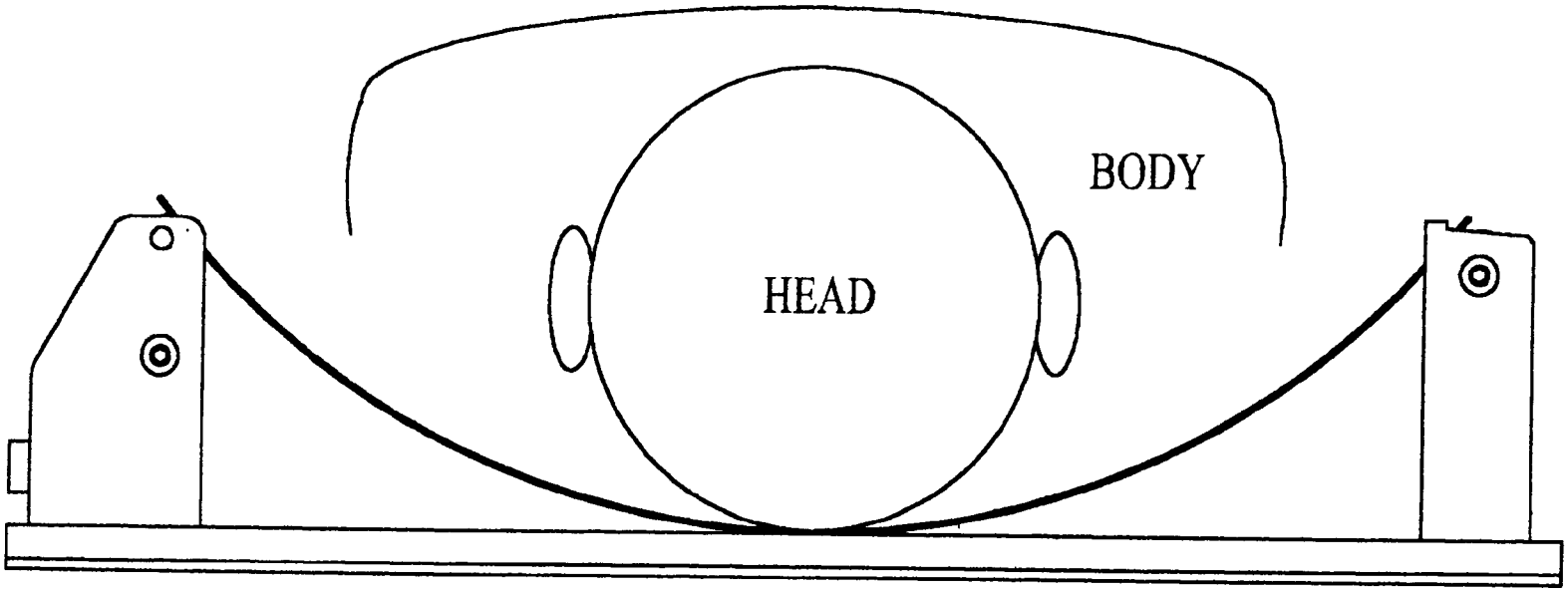
FIG 5-B

NECK EXERCISE APPARATUS

BACKGROUND OF THE INVENTION

1. Field of the Invention

The present invention relates to a muscle exercise apparatus and more particularly to an exercise apparatus designed to allow a person to safely perform isokinetic strengthening of the neck muscles. Such apparatus are used to perform exercises for strengthening both the anterior (front) and posterior (rear) muscles of the neck, the two areas most important for preventing and treating neck pain. Strengthening the neck muscles has been shown to prevent injury to the cervical spine, including injury from contact sports such as football and wrestling. Isokinetic neck exercises are also recommended therapy for treating neck complaints related to neck muscle strength.

2. Description of the Prior Art

A variety of apparatus and aids for exercise of the neck are found in the prior art. However, none of these apparatus or aids offer the advantages of the present invention, namely, none are as compact, portable, safe to use and as easy to operate as the present invention while at the same time providing for adjustable resistance and range of motion in the performance of isokinetic neck exercise.

A simple type of prior art apparatus utilizes a weight held to the head by the user. For example, U.S. Pat. No. 4,195,833 discloses a weight attached to the head by a weighted headband. The user performs exercise by moving his head through a range of motion against the gravitational pull of the weight. The weight may be simply suspended from the head, mounted on the head, or may be guided by a pulley attached to a fixed support. Such an apparatus offers the advantage of simplicity, but has at least two disadvantages. The first is that when the neck becomes more conditioned, additional weight is used until performance of the exercise becomes awkward with a risk of injury from the heavy weight falling to the ground. The second disadvantage is that these apparatus are not portable because they require the use of heavy weights. In particular, apparatus requiring a fixed pulley support are not conveniently portable. Portability is desired to allow the exercise apparatus to carried between and used at the users' convenience in their homes or offices, facilitating the desired frequency of use.

Another type of apparatus includes weight or resistance machines that include a means to move the head through a defined range of motion against an adjustable resistance while the user is constrained in a chair or on a bench. The prior art contains many variations on these types of machines. Examples are disclosed in U.S. Pat. Nos. 4,893,808; 5,116,359; 5,273,504 and 5,336,138. However, all of these machines are intended to be permanently mounted to a chair or bench, and all are relatively complex, heavy, and expensive in comparison to the present invention. None are lightweight and easily portable as is the present invention.

A third type of apparatus includes those which are intended to be mounted on the body and provide for resistance and range of motion by pushing against other parts or other muscles of the body, with or without an intermediary tension or compression device. For example, U.S. Pat. No. 4,789,154 discloses an exercise device comprised of a U-shaped bar which the user places over the head and exerts force on the head by pulling or pushing on the bar with the user's arms. Another example is disclosed by U.S. Pat. No. 5,501,646, disclosing a device intended to be mounted under the chin of the user to provide an elastic resistance against the user's own chest. In contrast, the present invention allows for adjustable resistance against a fixed surface without a need to push against other parts of the body, thereby avoiding pressure on other parts of the body and providing for a more repeatable and measurable force of exercise. The repeatability and measurability of the present device facilitates use as a therapeutic or training device under the supervision of a physician or therapist. The body-mounted devices also are not capable of providing the same range of motion and force of exercise as is the present invention. The present invention offers a range of exercise more desirable for strengthening the neck, and is more easily adapted for a variety of exercises in different positions.

SUMMARY OF THE INVENTION

A neck exercise apparatus for developing strength, endurance, and flexibility in the neck. The apparatus comprises a leaf spring that is held by a support at each end. The leaf spring and its supports are mounted on a base. The distance between the supports can be adjusted to vary the force necessary to deflect the leaf spring. A gauge block may placed beneath the center of the spring to measure and to limit the range of motion of the exercise.

To perform exercises of the neck using the apparatus, a user places the front or back of the head against the leaf spring and pushes against the flat surface of the leaf spring using the muscles of the neck, thereby deflecting the leaf spring. The user then relaxes the neck muscles and allows the leaf spring to return to its undeflected position. The exercise is then repeated for as many cycles as desired.

BRIEF DESCRIPTION OF THE DRAWINGS

FIGS. 5A and 5B illustrates one use of the apparatus to perform exercises of the neck, where FIG. 5A shows the apparatus in an undeflected position and FIG. 5B shows the apparatus at its point of maximum deflection.

DESCRIPTION OF THE PREFERRED EMBODIMENT

Figure 1:
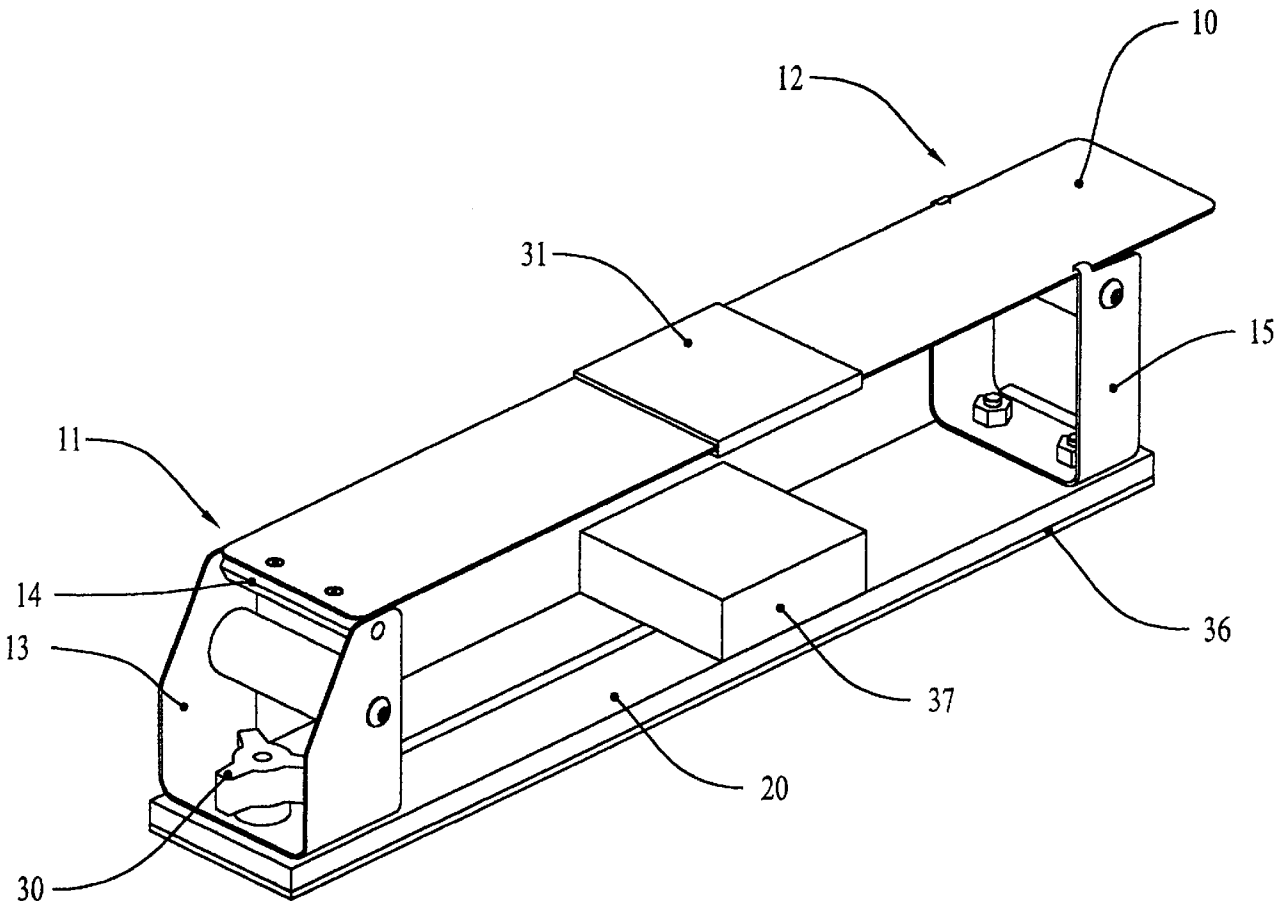
FIG. 1 shows an isometric view of the preferred embodiment of the invention, embodying the principles of the invention.

With reference to the drawing, FIG. 1 shows a view of the preferred embodiment of the invention. Leaf spring (10) having fixed pivot end (11) and free pivot end (12) is mounted on fixed pivot support (13) and pivot (14) at fixed pivot end (11), and on free pivot support (15) at free pivot end (12). The leaf spring (10) may be comprised of any flexible material including suitable plastics and composite materials, but the preferred material is tempered spring steel having a thickness and span to provide the desired spring constant. Materials of varying flexibility may be used to provide the desired spring constant. For example, for a rectangular leaf spring of constant width and thickness, the spring constant, K, is expressed mathematically as $K=4Ebt^3/L^3$, where K is proportional to the material modulus of elasticity (E), the spring width (b), the cube of the spring thickness (t) and inversely proportional to the cube of the span (L).

Leaf springs are preferred because they have one principle plane of flexure and are stiff in flexure out of the principle plane. In the preferred embodiment of the invention, the leaf spring is a single flat, rectangular piece of steel, of a size to comfortably fit the intended users of the exercise apparatus and to provide the desired spring force. In alternative embodiments of the invention, the leaf spring need not be rectangular or of uniform thickness; for example, the width or thickness of the leaf spring may be varied to obtain the desired spring force, ergonomic properties, and aesthetic qualities. The single leaf spring may also be replaced by a plurality of leaf springs in alternative embodiments of the invention.

Figure 2:
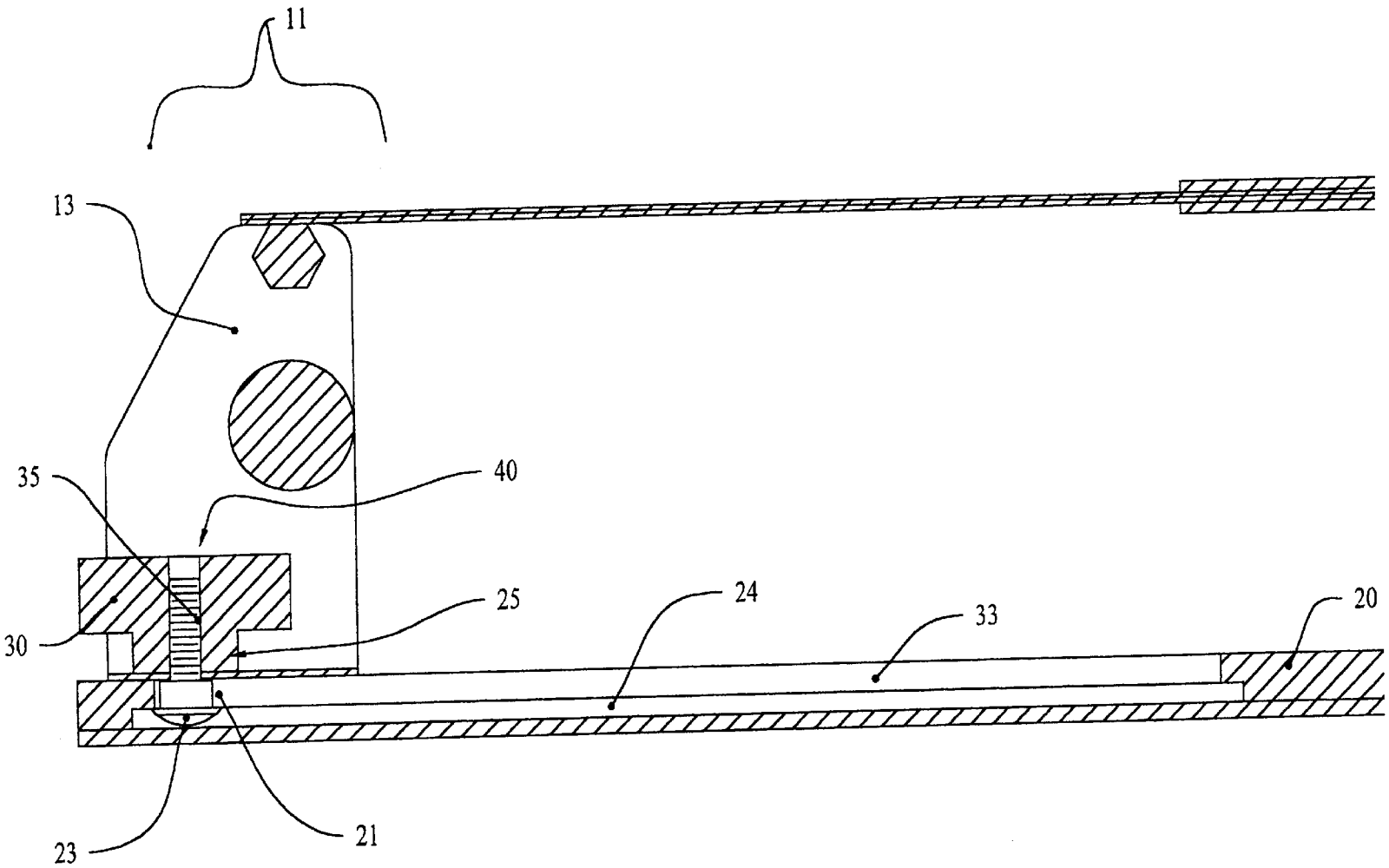
FIG. 2 is a cross sectional view of the slidable pivoting support for the leaf spring of the preferred embodiment.
Figure 3:
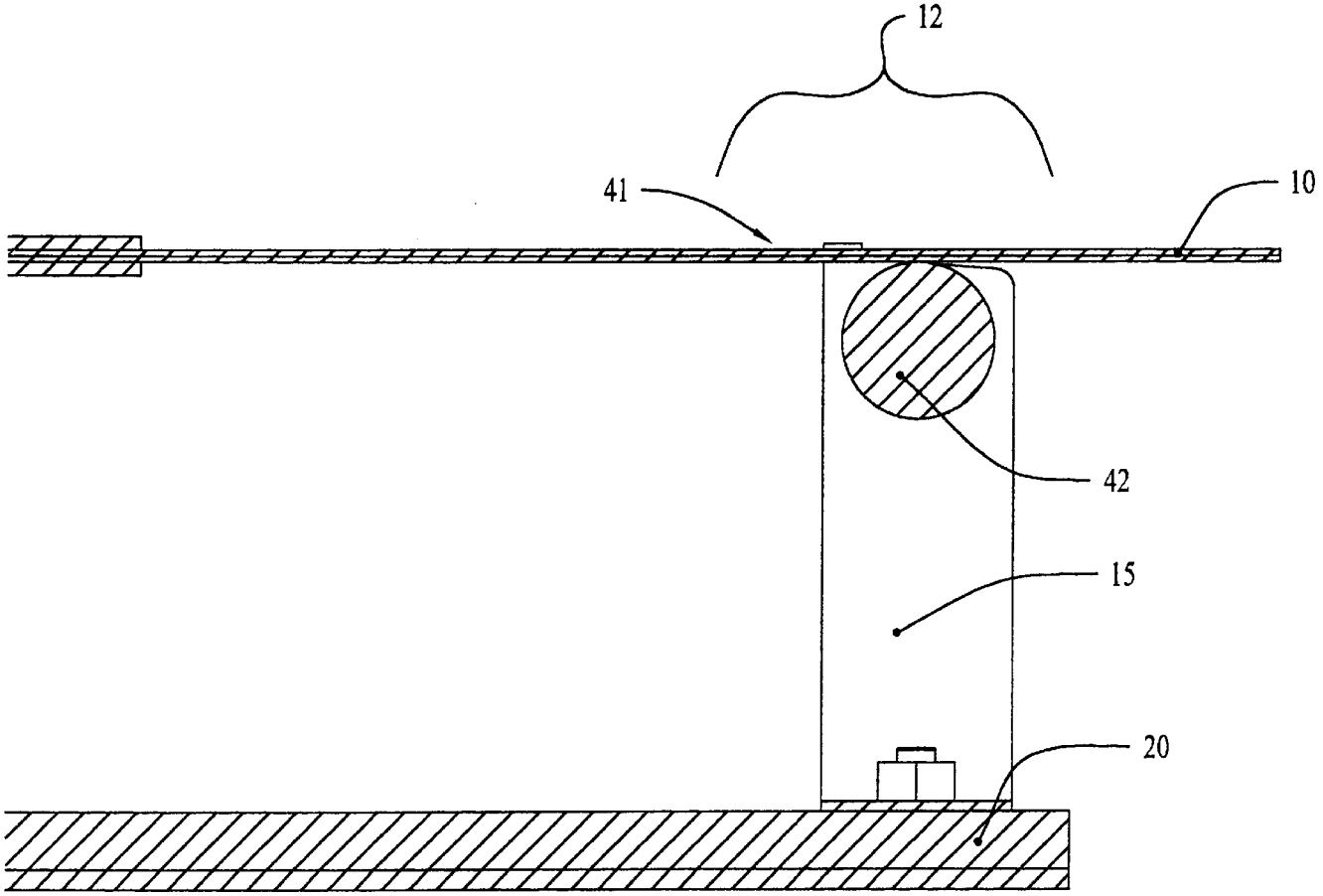
FIG. 3 is a cross sectional view of the support for the leaf spring of the preferred embodiment opposite to the support shown in FIG. 2.

The pivot supports (13) and (15) and the base (20) are preferably made of plastic, but may be fashioned from any suitable material, including wood and other structural materials. To provide a means for adjusting the unsupported span of the leaf spring between the pivot supports, fixed pivot support (13) shown in FIG. 2 is slide mounted to base (20) by adjustment threaded nut (30) set in adjustment slot (24) and by threaded tracking stud (21). Threaded tracking stud (21) passes through adjustment slot (24) in base (20) and is rigidly attached to fixed pivot support (13). Thread tracking stud (21) passes through adjustment slot (24) in base (20) and through hole (25) in fixed pivot support (13) and into adjustment knob (30). Free pivot support (15) shown in FIG. 3 is rigidly mounted on base (20) opposite to fixed pivot support (13). In the alternative, the fixed pivot support (13) may be rigidly attached to base (20) and the free pivot support (15) may be a sliding type attachment to the base (20), without any adverse effect on the operation of the apparatus. The supports are preferably adjustable along the base from between 6 inches apart to the full length of the base apart.

Pressure pad (31) in FIG. 1 is slidably mounted on leaf spring (10). Non-skid material (36) is fixedly attached to the bottom surface of base (20).

Gauge block (37) is unattached to any part and may be used to limit and measure the deflection of leaf spring (10) as desired, by placing it on base (20) directly underneath pressure pad (31) so that the bottom of the pressure pad contacts the upper surface of the gauge block when the spring is deflected to its desired maximum deflection. The gauge block is preferably a rectangular parallelpiped constructed of any durable solid material. It may be removably attached to the base (20) by a suitable removable attachment means.

FIG. 2 is a cross sectional view of the fixed pivot support (13) and base (20), showing the means for slidably mounting the fixed pivot support (13). Other means for slidably mounting the fixed pivot support to the base may be devised by those skilled in the art. Threaded tracking stud (21) having shoulder (23) is retained by slot shoulder (33) of adjustment slot (24). The opposite end of threaded tracking stud (21) is fixedly retained in fixed pivot support (13) by screw threads or equivalent holding means. Threaded tracking stud (21) having shoulder (23) retained by slot shoulder (33) passes through hole (25) in fixed pivot support (13). Threaded end (35) of threaded tracking stud (21) is engaged by threaded hole (40) in adjustment knob (30). Turning adjustment knob (30) causes fixed pivot end (11) to be compressed against base (20) by drawing threaded tacking stud (21) into threaded hole (40). Compression is relieved by turning adjustment knob (30) in the opposite direction, allowing fixed pivot support to slide along base (20) to the extent allowed by adjustment slot (24) and threaded tracking stud (21).

FIG. 3 is a cross sectional view of free pivot support (15) and leaf spring (10) showing the preferred means for supporting the free pivot end (12) of leaf spring (10). Retaining arms (41) retain leaf spring (10) against bearing surfaces (42) such that leaf spring (10) is free to slide past bearing surfaces (42) along base (20), so that as leaf spring (10) is deflected by application of force to pressure pad (31) directed towards base (20), leaf spring (10) may slide past and rotate about bearing surface (42).

Figure 4:
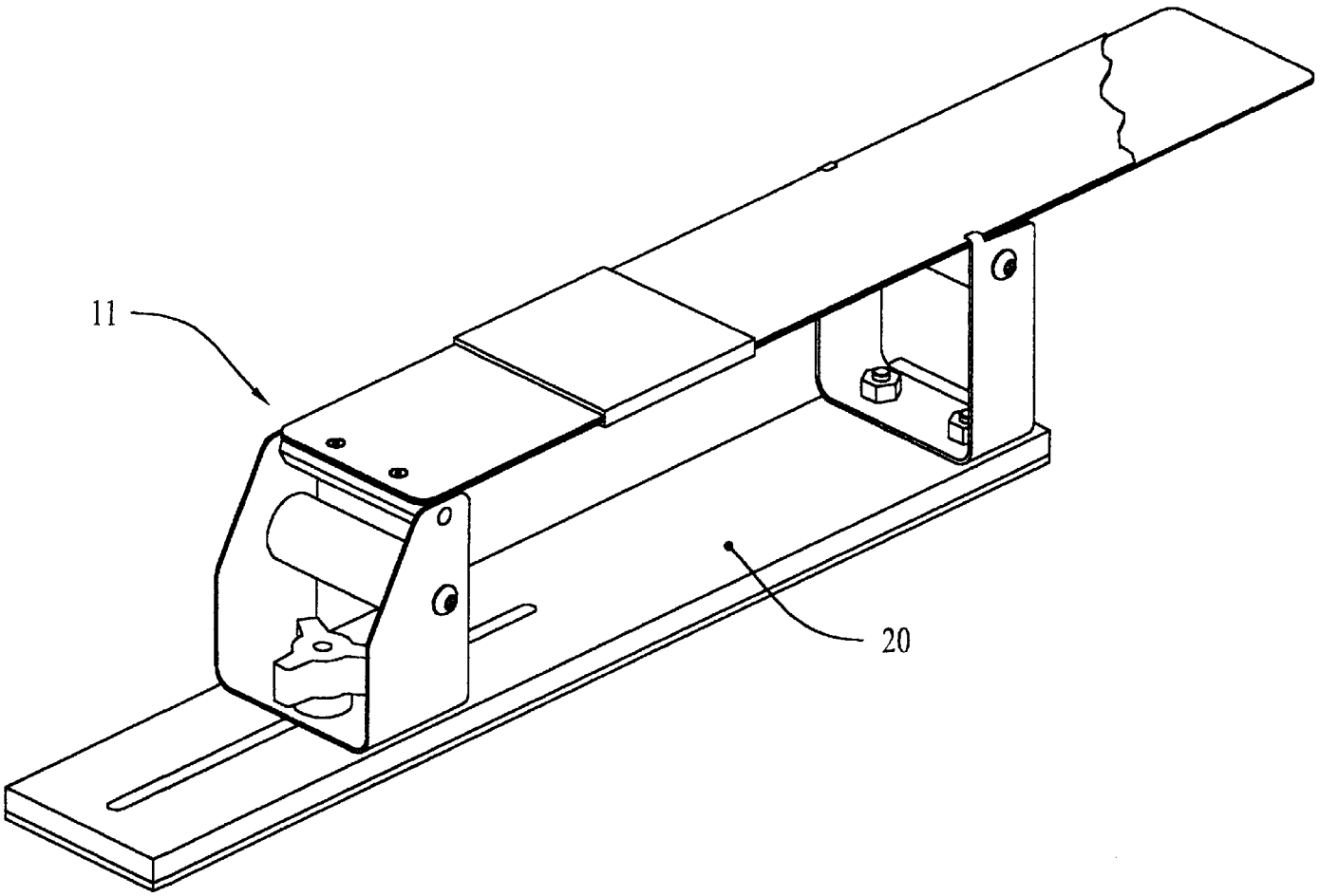
FIG. 4 illustrates the adjustability of the apparatus by showing the preferred embodiment with fixed pivot end adjusted to an intermediate position in its base.

The adjustability of the apparatus is illustrated by FIG. 4, showing the preferred embodiment with fixed pivot end (11) adjusted to an intermediate position along base (20). When the apparatus is adjusted to an intermediate position, bringing the spring supports closer together and decreasing the unsupported span of the leaf spring, the force necessary to deflect the leaf spring a given distance is increased. Thus the user can adjust the resistance provided by the neck exercise apparatus by adjusting the position of the leaf spring supports.

One use of the device to perform exercises of the neck is illustrated by FIG. 5A. User (50) reclines on floor (52) and moves head (53) against the resistance of leaf spring (10) through the range of motion indicated by arrow. At the point of maximum deflection of the leaf spring as shown in FIG. 5B, it is deflected by a distance indicated by (55). The apparatus may be used with the user in a variety of positions, supine or reclining, and supported by a floor, a wall, or a chair.

Figure 6:
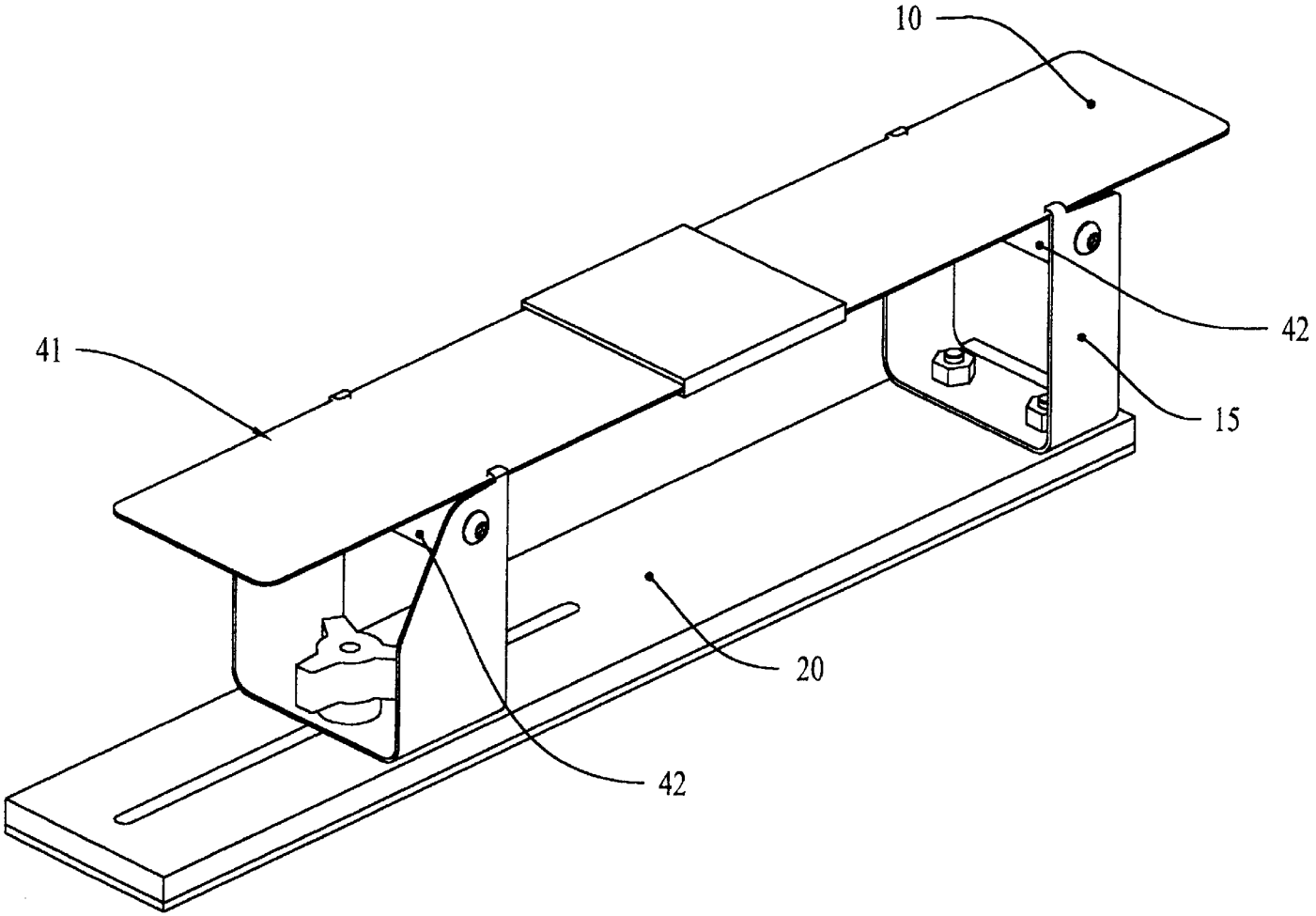
FIG. 6 illustrates an alternative embodiment of the invention in which neither support is fixed to the leaf spring.

FIG. 6 shows an alternate embodiment of the invention. Leaf spring (10) is supported at both ends and free to slide between both bearing supports (42) with retaining arms (41). Bearing surfaces (42) are mounted on an adjustable support (13) on one end of the base and on a fixed support (15) at the other end of the base.

Figure 7:
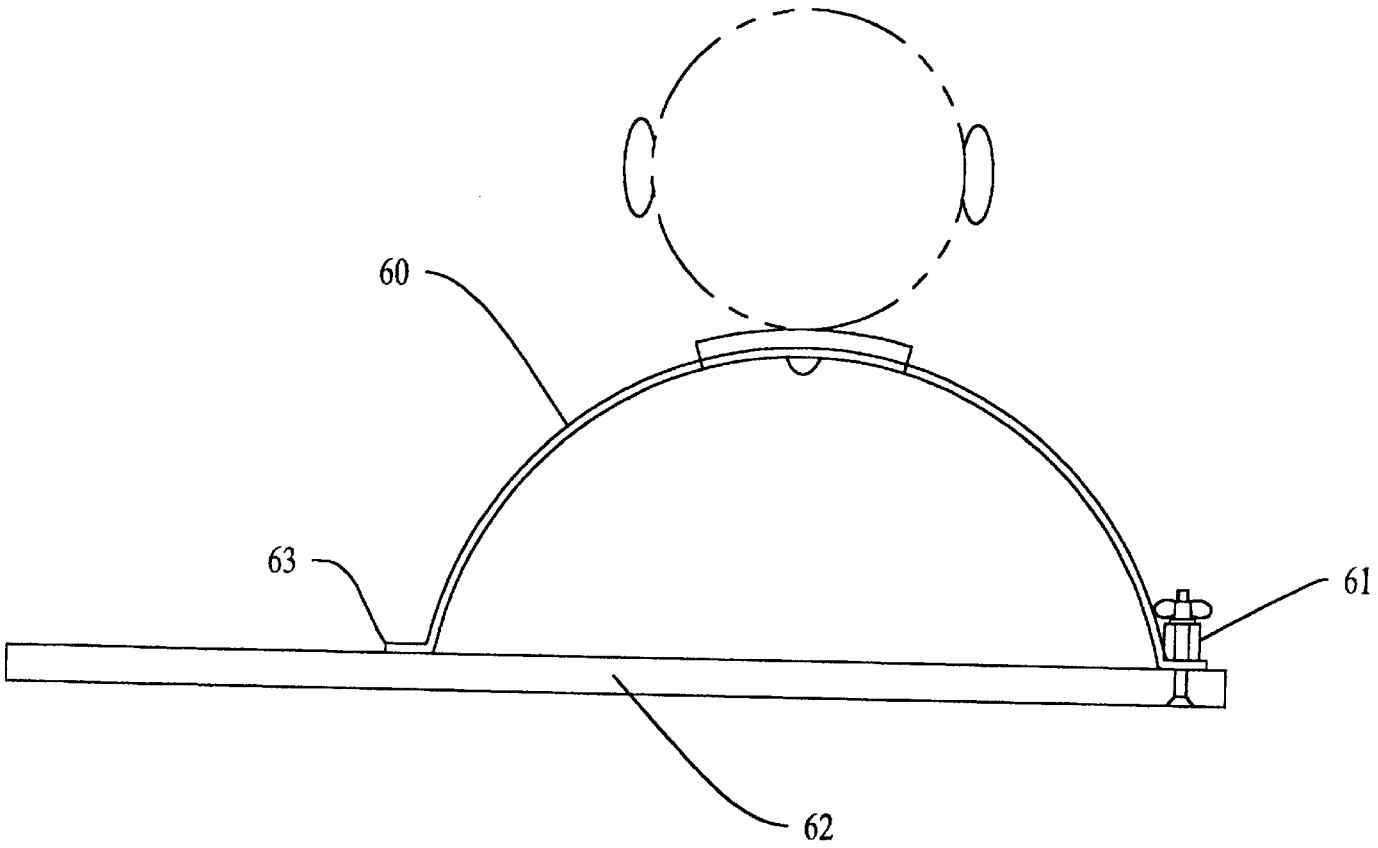
FIG. 7 shows an alternate embodiment of the invention utilizing a curved leaf spring supported directly by the base.

FIG. 7 shows another embodiment of the invention. Leaf spring (60) is permanently set in a semielliptical shape having a clamped pivot end (61) mounted on base (62) and a free end (63) resting on base (62). Downward motion from a persons head on the center of the semielliptical spring (60) causes the spring to flatten as the free end (63) slides on the base (62) and provides a reaction force to the head.

The foregoing disclosure is illustrative only and the scope of the invention should be determined by the appended claims.

We claim:

1. A neck exercise apparatus, comprising (a) a leaf spring having two ends, one long axis, a midpoint, and one principle plane of flexure, and having a stiffness and a length between said two ends;

(b) a first pivot support supporting said leaf spring at one end of said leaf spring;

(c) a second pivot support supporting said leaf spring along its long axis between said midpoint of said leaf spring and the end of said leaf spring opposite to said first pivot support;

(d) a base retaining said first pivot support and said second pivot support;

(e) an unsupported span of said leaf spring spanning said first pivot support and said second pivot support so that said leaf spring may be flexed towards said base in said leaf spring's principle plane of flexure by pressure applied to said unsupported span of said leaf spring;

(f) means for supporting and retaining said leaf spring by said second pivot support so that said leaf spring may rotate about said second pivot support and so that said leaf spring is free to slide relative to said second pivot support;

(g) means for attaching said leaf spring to said first pivot support so that said leaf spring is prevented from sliding but may rotate about said first pivot support;

(h) means for adjusting said unsupported span of said leaf spring by adjusting the distance between said first and second pivot supports along said base;

(i) a gauge block placed on said base directly under the center of said unsupported span of said leaf spring for limiting and measuring the flexure of said leaf spring towards said base;

wherein said stiffness and said length of said leaf spring are such that said leaf spring may be flexed sufficiently to permit exercise of the neck when pressure is applied to said unsupported span of said leaf spring.

2. A neck exercise apparatus, comprising (a) a leaf spring having two ends, one long axis, a midpoint, and one principle plane of flexure, and having a stiffness and a length between said two ends;

(b) a first pivot support supporting said leaf spring at one end of said leaf spring;

(c) a second pivot support supporting said leaf spring along its long axis between said midpoint of said leaf spring and the end of said leaf spring opposite to said first pivot support;

(d) a base retaining said first pivot support and said second pivot support;

(e) an unsupported span of said leaf spring spanning said first pivot support and said second pivot support so that said leaf spring may be flexed towards said base in said leaf spring's principle plane of flexure by pressure applied to said unsupported span of said leaf spring;

(f) means for supporting and retaining said leaf spring by said second pivot support so that said leaf spring may rotate about said second pivot support and so that said leaf spring is free to slide relative to said second pivot support;

(g) means for attaching said leaf spring to said first pivot support so that said leaf spring is prevented from sliding but may rotate about said first pivot support;

(h) means for adjusting said unsupported span of said leaf spring by adjusting the distance between said first and second pivot supports along said base;

(i) a pressure pad slidably mounted between said first pivot support and said second pivot support on said leaf spring;

wherein said stiffness and said length of said leaf spring are such that said leaf spring may be flexed sufficiently to permit exercise of the neck when pressure is applied to said unsupported span of said leaf spring.

3. A neck exercise apparatus, comprising (a) a leaf spring having two ends, one long axis, a midpoint, and one principle plane of flexure, and having a stiffness and a length between said two ends;

(b) a first pivot support supporting said leaf spring at one end of said leaf spring;

(c) a second pivot support supporting said leaf spring along its long axis between said midpoint of said leaf spring and the end of said leaf spring opposite to said first pivot support;

(d) a base retaining said first pivot support and said second pivot support;

(e) an unsupported span of said leaf spring spanning said first pivot support and said second pivot support so that said leaf spring may be flexed towards said base in said leaf spring's principle plane of flexure by pressure applied to said unsupported span of said leaf spring;

(f) a pressure pad slidably mounted between said first pivot support and said second pivot support on said leaf spring;

wherein said stiffness and said length of said leaf spring are such that said leaf spring may be flexed sufficiently to permit exercise of the neck when pressure is applied to said unsupported span of said leaf spring.

* * * * *